US005231960A

United States Patent [19]

White

[11] Patent Number: 5,231,960

[45] Date of Patent: Aug. 3, 1993

[54] METHOD AND APPPARATUS FOR VARYING INTAKE AND EXHAUST VALVE OPENING AND CLOSING IN A RECIPROCATING PISTON ENGINE

[76] Inventor: Ambrose White, 713 Avenue G, Kentwood, La. 70444

[21] Appl. No.: 718,776

[22] Filed: Jun. 21, 1991

[51] Int. Cl.[5] ..... F01L 1/34; F01L 1/14

[52] U.S. Cl. ..... 123/90.16; 123/90.48; 123/90.5

[58] Field of Search ..... 123/90.15, 90.16, 90.17, 123/90.48, 90.5, 90.52

[56] References Cited

U.S. PATENT DOCUMENTS

| | | | |
|---|---|---|---|
| 1,501,041 | 7/1924 | Cutler | 123/90.16 |
| 1,755,817 | 4/1930 | Dibley | 123/90.16 |
| 1,798,508 | 9/1938 | Tucker | 123/90.16 |
| 2,663,288 | 12/1953 | Hutchison | 123/90.16 |
| 3,986,351 | 10/1976 | Woods et al. | 123/90.15 |
| 4,335,685 | 6/1982 | Clouse | 123/90.5 |
| 4,361,120 | 11/1982 | Kueny | 123/90.5 |
| 4,583,498 | 4/1986 | Magnet | 123/90.15 |
| 4,869,215 | 9/1989 | Parsons | 123/90.16 |

*Primary Examiner*—E. Rollins Cross
*Assistant Examiner*—Weilun Lo

[57] ABSTRACT

A modified camshaft and a modified cam follower control valve overlap and vary intake and exhaust valve opening and closing in a reciprocating piston engine. The camshaft and cam follower are modified to cause the intake valve of a piston cylinder to open at top dead center and close at bottom dead center of the intake stroke of a piston. The exhaust valve is caused to open at bottom dead center and close at top dead center to the exhaust stroke of the piston. The modification of a camshaft includes the shaping and spacing of the cam lobes to achieve, in conjunction with a modified cam follower, a desired duration and initiation of valve opening. The modification of the cam follower includes a novel shaping of the lower portion of a cam follower.

16 Claims, 1 Drawing Sheet

METHOD AND APPPARATUS FOR VARYING INTAKE AND EXHAUST VALVE OPENING AND CLOSING IN A RECIPROCATING PISTON ENGINE

TECHNICAL FIELD OF THE INVENTION

This invention relates to reciprocating piston engines, and more particularly to a method and apparatus for varying intake and exhaust valve opening and closing in a reciprocating piston engine.

BACKGROUND OF THE INVENTION

In a reciprocating four-stroke piston engine, each piston cylinder has an intake valve and an exhaust valve. The intake valve opens on a downstrike of the piston and an air-fuel mixture is drawn into the cylinder chamber. The mixture is compressed on the ensuing upstroke. Combustion is initiated at the top of that upstroke. The combustion forces the piston through a downstroke. The exhaust valve opens to expel gases on the final upstroke of the four-stroke cycle. The four-stroke cycle then begins again with the opening of the intake valve and a downstroke of the cylinder. A cam on a camshaft controls the opening and closing of each valve, respectively. In common engine design, there is a period during which the intake valve and exhaust valve are open simultaneously. This occurs during the end of the exhaust upstroke and the beginning of the intake downstroke when the intake valve opens prior to complete closing of the exhaust valve. This simultaneous open-valve position is called "valve overlap." In many instances it would be desirable to reduce or otherwise modify the duration or instant of occurrence of valve overlap. An important reason would be to increase engine efficiency by not exhausting some of the air-fuel mixture with gases during the exhaust upstroke or by not mixing gases which are combustion by-products with the air-fuel mixture.

It can be appreciated that it would be desirable to have a means for controlling valve overlap in a reciprocating piston engine. It can also be appreciated that it would be desirable to have a means for varying intake and exhaust valve opening and closing in a reciprocating piston engine.

BRIEF SUMMARY OF THE INVENTION

It is an object of the invention to provide a means for controlling valve overlap in a four-stroke reciprocating piston engine.

It is also an object of the invention to provide a means for varying intake and exhaust valve opening and closing in a reciprocating piston engine.

The present invention utilizes a modified camshaft and a modified cam follower to control valve overlap and vary intake and exhaust valve opening and closing in a reciprocating piston engine. In a preferred embodiment, a camshaft and cam follower are modified to cause the intake valve of a piston cylinder to open at top dead center and close a bottom dead center of the intake stroke of a piston. The exhaust valve is caused to open at bottom dead center and close at top dead center of the exhaust stroke of the piston. The modification of a camshaft includes the shaping and spacing of the cam lobes to achieve, in conjunction with a modified cam follower, a desired duration and initiation of valve opening. The modification of the cam follower includes a novel shaping of the lower portion of a cam follower.

Other aspects, objects, features, and advantages of the present invention will become apparent to those skilled in the art upon reading the detailed description of preferred embodiments in conjunction with the accompanying drawings and appended claims.

DETAILED DESCRIPTION OF PREFERRED EXEMPLARY EMBODIMENTS OF THE INVENTION

Figure 1:
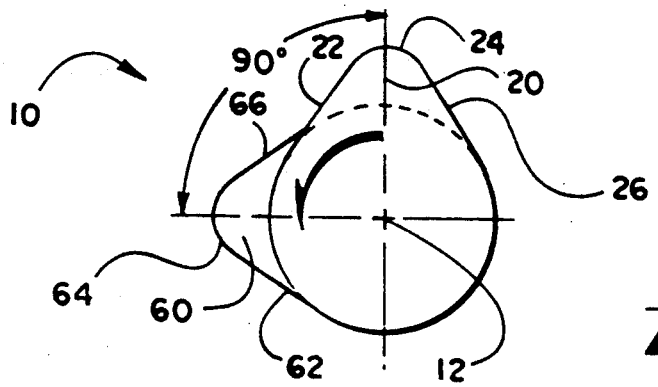
FIG. 1 is a front elevational view of a section of a camshaft embodying teachings of the invention, illustrating the positioning of an intake cam and exhaust cam with respect to one another.

While the specification concludes with claims particularly pointing out and distinctly claiming the subject matter which is regarded as the present invention, the invention will now be described with reference to the following description of an embodiment taken in conjunction with the accompanying drawings.

In a four-stroke reciprocating piston engine, each piston reciprocates in a cylinder. The topmost position of the piston is referred to as "top dead center," and abbreviated "TDC." The bottommost position of the piston is referred to as "bottom dead center," and is abbreviated "BDC." The reciprocating, translational motion of each piston directly relates to the rotation of a crankshaft. One-half revolution of the crankshaft equates to movement of a piston from TDC to BDC. An additional one-half revolution brings the piston back to TDC. Piston movement either from TDC to BDC or from BDC to TDC is one "stroke" of the four-stroke engine. The four strokes are the intake stroke, the compression stroke, the power stroke and the exhaust stroke. Using the intake stroke as a starting point, the piston moves from TDC to BDC. An air-fuel mixture is taken into the piston cylinder during this stroke. The mixture is compressed on the upstroke from BDC to TDC. At TDC the compressed mixture is ignited causing expansion of gases in the cylinder. The expansion of gases forces the piston through a down stroke wherein power is delivered to the crankshaft. On the final stroke of the four-stroke cycle the piston moves from BDC to TDC forcing the gases tot he top of the cylinder. The four-stroke cycle immediately begins again. A camshaft controls the opening and closing of the intake valves and exhaust valves. The opening and closing of each valve is controlled by the rotation of a cam on the camshaft. The rotation of the camshaft is directly related to the rotation of the crankshaft. One complete rotation of the crankshaft equates to one-half rotation of the camshaft. And, in turn, each stroke of a piston is one-half turn of the crankshaft (180 degrees) and one-quarter turn of the camshaft (90 degrees).

Valve overlap is a condition that occurs when the exhaust valve and intake valve are open at the same time. The overlap may be due to the exhaust valve remaining open late, that is, after the piston starts its intake stroke, or it may be due to the intake valve opening early, that is, before the piston completes its exhaust stroke, or it may be due to a combination of the two. A common engine design causes a valve to remain open for 120 degrees of camshaft rotation. This exceeds by 30 cam-degrees the 90 cam-degrees (which equates to 180 crankshaft-degrees), the duration of a complete intake downstroke or a complete exhaust upstroke. The invention enables a valve to stay open for a shorter duration than that found in an engine of traditional design and, further, enables that open duration to be equal to the 90 cam-degrees that equates to 180 crankshaft-degrees for a complete intake or exhaust stroke. The invention uses two features to vary the opening and closing of intake and exhaust valves, namely, (1) modification of a camshaft and (2) modification of the cam followers which are translated by the cam lobes of the camshaft.

The preferred embodiment illustrated completely eliminates valve overlap by opening and closing the exhaust valve during the exhaust upstroke (which equates to a 180-degree rotation of the crankshaft and a 90-degree rotation of the camshaft) and opening the intake valve at the end of the exhaust stroke (which is the beginning of the intake stroke) and closing the intake valve at the end of the intake stroke (which also equates to a 180-degree rotation of the crankshaft and a 90-degree rotation of the camshaft). In the illustrated preferred embodiment, a camshaft in which each intake cam lobe and each exhaust cam lobe is designed (in conjunction with the design of the cam follower) to open and close within a 90-degree rotation of the camshaft. In addition, each set of intake and exhaust cam lobes is spaced to allow the exhaust valve to fully open and fully close before the intake valve opens. This equates to the 90-degree spacing between the exhaust and intake cam lobes. Cam followers, in general, have either a dome-like bottom portion which engages the cam, a flat bottom portion which engages the cam or a roller which protrudes from the bottom portion which engage the cam. In the illustrated preferred embodiment, FIGS. 2 and 3, the cam follower is modified to provide a trailing edge which causes the cam follower to become disengaged from the cam lobe sooner than it would be in the case of a cam follower which is not modified.

Figure 2:
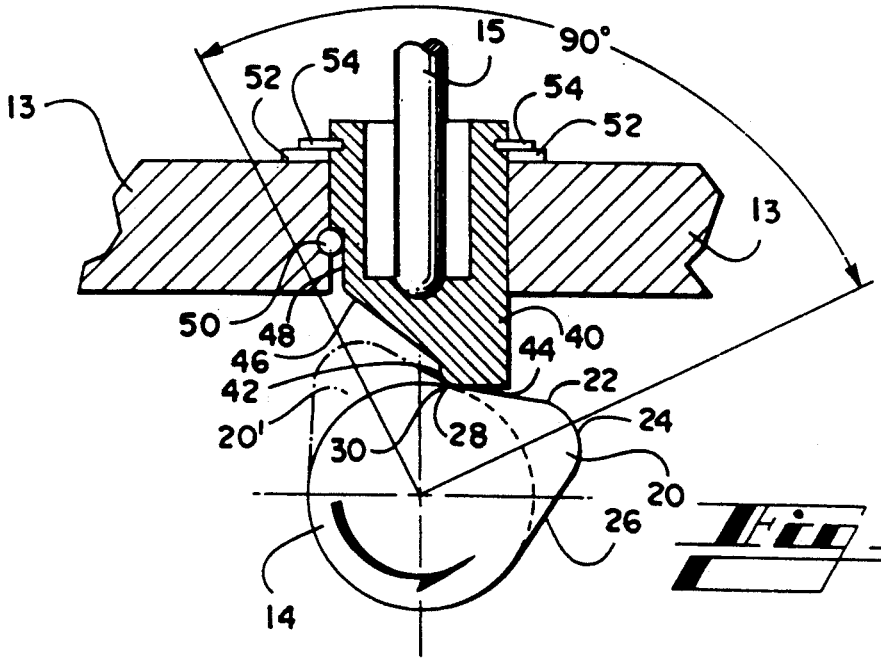
FIG. 2 is a frontal view of a section of an engine illustrating the positioning and movement of a cam and cam follower embodying teachings of the invention.
Figure 3:
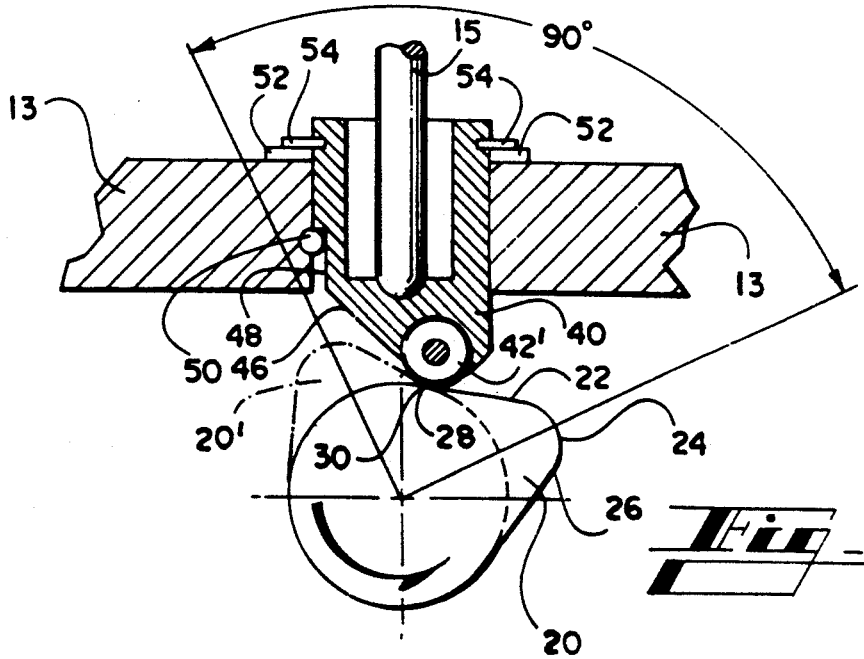
FIG. 3 is a frontal view of a section of an engine illustrating the positioning and movement of a cam and cam follower in an alternative embodiment of the invention as illustrated in FIG. 2.

Reference will now be made to FIGS. 1–3 in which the same numbers are indicative of the same elements throughout the figures. In FIG. 1, therein is illustrated a frontal view of a section of a camshaft 10 embodying teachings of the present invention. Cams 14 and 16 with cam lobes 20 and 60, respectively, rotate about the axis 12 of the camshaft 10. The intake valve cam lobe 20 is designed to open an intake valve when the lifting ramp 22 of the intake valve cam lobe 20 lifts an intake valve cam follower and close that intake valve when the closing ramp 26 of the intake valve cam lobe 20 lowers the intake valve cam follower. Likewise, the exhaust valve cam lobe 60 is designed to open an exhaust valve when the lifting ramp 62 of the exhaust valve cam lobe 60 engages an exhaust valve cam follower and close that exhaust valve when the closing ramp 66 of the exhaust valve cam lobe 60 engages the exhaust valve cam follower. The cam lobes 20 and 60 are designed so that the respective intake and exhaust valves are open and closed during a rotation of 90 degrees of the camshaft. There is also a 90-degree spacing between the exhaust valve cam lobe 60 and the intake valve cam lobe 20. This spacing is illustrated by noting the angle between the nose 24 of the intake valve cam lobe 20 and the nose 64 of the exhaust valve cam lobe 60. The 90-degree spacing allows the exhaust valve to fully open and close before the intake valve opens, as discussed above.

Referring now to FIG. 2, therein is illustrated one of the cams shown in FIG. 1, a corresponding cam follower 40 configured in accordance with the teachings of a preferred embodiment of the invention, and the interaction between the cam lobe 20 and the cam follower 40. For reference and identification purposes the cam 14 with lobe 20 illustrated and discussed is referred to as an intake cam, however, the description of the structure and operation of this cam 14 and lobe 20 would be equally applicable to an exhaust cam 16 and lobe 60. The cam 14 rotates counterclockwise. The solid representation of the cam 14 illustrates the cam 14 in a position at which the cam lobe 20 initially lifts, or translates, the cam follower 40. The phantom (dotted line) representation illustrates the cam 14 with lobe 20 (20') in a position at which the lobe 20 (20') has just completed lowering the cam follower 40. The cam lobe 20 is configured to work in conjunction with the cam follower 40 to cause opening and closing of the corresponding valve within a 90 degree rotation of the cam 14. The cam lobe 20 has a lifting ramp 22, a nose 24 and a lowering ramp 26. During the 90-degree rotation of the cam 14 that opens and closes a valve, a point on the lower portion of the cam follower 40 is engaged by the lifting ramp 22, nose 24 and lowering ramp 26 of the cam lobe 20. The intake and exhaust valve typically consists of a valve head and a valve stem. Translational motion is imparted to the valve either by direct action upon the valve stem or by movement of a push rod which in turn imparts motion to the valve through a linkage. In typical engine use, the cam follower 40, engages either the valve stem or a valve push rod. The cam follower 40 has a top portion which receives either a valve stem or valve push rod 15 and translates the valve stem or push rod 15 as the cam follower 40 is translated. The valve stem or push rod 15 is shown being received within a hollow center portion of the cam follower 40. The interaction between the cam follower 40 and a valve stem or the cam follower and the push rod would be the same, therefore, the valve stem and push rod 15 are referred to interchangeably with respect to the cam follower 40. The lower portion of the cam follower 40 is configured to work in conjunction with the cam lobe 20 to provide the desired amount and duration of lift. The cam follower 40 has a generally cylindrical shape and translates within a cylindrical opening in the engine block 15. The lower portion has a leading edge 44 which is the part of the cam follower 40 that is engaged by and is in contact with the cam lobe 20 during lifting and lowering of the cam follower 40. The cam follower 40 has a trailing edge 46 that is configured so that the cam lobe 20 does not engage the trailing edge as the cam 14 rotates. The trailing edge 46 in the embodiment illustrated is shown as a plane which obliquely cuts through the lower portion of the cam follower 40. On the lower portion of the cam follower 40, at the intersection of the trailing edge 46 and the leading edge 44 is a curved surface, or shoulder, 42 that serves as the contact point for the initial lifting of the cam follower by the lifting ramp 22 of the cam lobe 20 and the final engagement point for the lowering ramp 26 of the cam lobe 20. The contact between the contact curve 42 and the beginning of the lifting ramp 22 of the cam lobe 20 is shown in the solid line illustration of the cam lobe 20. The phantom depiction of the cam lobe 20' shows the cam lobe 20' in a position at which the cam follower 40 has been lowered. The lowering ramp 26 of the cam lobe 20 is shown engaging the contact curve 42 of the cam follower 40 at the same point at which the lifting ramp 22 initially made contact with the contact curve 42. The cam lobe 20 does not make contact with the trailing edge of the cam follower 40 because the trailing edge is cut away at an angle to prevent contact with the lower portion of the cam follower 40 beyond the contact curve 42. This enables the cam follower 40 to be completely lowered faster than one which has not been modified in accordance with teachings of the invention. The contact curve 42 is shown as being slightly to the right of the center line of the cam follower 40 and cam 14 to achieve the 90 degree opening and closing desired in this embodiment. Movement of the contact curve 42 to the left or right of the position shown varies the lifting duration of the cam follower 40. This would also equate to a change in the angular distance between the intake lobe 20 and the phantom representation of the intake lobe 20'. The manner of cooperation between the cam and cam follower may also be achieved by utilizing cams of a larger, smaller or different configuration. For example, by using a cam lobe 20 of a larger size, it is possible to fully lift the cam follower 40 quicker and hold it in the lifted position longer and then lower it faster without changing the total lifting duration (that is, period during which the valve is "open"). As previously stated, in the embodiment illustrated, the cam follower 40 is cylindrical and is thus likely to rotate within the engine block 13 in which it is seated. If the cam follower 40 rotates, the cam lobe 20 will not properly engage the cam follower 40. Therefore, it is necessary to prevent rotation of the cam follower 40. In the embodiment shown, this is done by creating a flat notch 48 in the cam follower 40 which is a plane surface separated from the other portion of the cam follower 40 by a shoulder. In conjunction with the creation of the flat notch 48, a pin 50 is installed in the engine block for engaging the notched portion 48 of the cam follower 40. The cam follower 40 is able to translate in to-and-fro reciprocating motion but does not rotate. The exact points of contact between the cam follower 40 and cam lobe 20 must be maintained once established. To aid in this regard, a retaining ring 54 is placed around the cam follower 40 to prevent the cam follower 40 from moving downward below the point of attachment of the retaining ring 54 to the cam follower 40. A method of attaching a retaining ring 54 is to place a groove around the cam follower 40 and insert a snap ring 54 is to place a groove. In order to maintain optimum operation, the cam follower 40 must normally be kept in close contact with members that connect the cam follower to the valve (that is, the valve stem or push rod 15 and any linkage associated therewith). To help keep the cam follower 40 in contact with these connecting members a slight upward force is applied to the cam follower 40 when it is in its lowermost position. This is accomplished by insertion of a spring washer 52 between the retaining ring 54 and the engine block 13 as shown.

Referring now to FIG. 3, therein is shown a preferred embodiment of the invention as illustrated in FIG. 2 except that the cam follower 40 uses a roller 42' as its contact point rather than the contact curve 42 which is shown in FIG. 2.

The preferred embodiment of the invention discussed above completely eliminates valve overlap. However, the invention may be practiced to provide valve overlap as desired but without being limited to the amount of valve overlap inherent in the original engine design. For example in the case of an engine which has a "supercharger" which forces air into a cylinder to enhance air intake, in order to purge expended combustion gases from the cylinder it may be desirable to allow the exhaust valve to remain open during a part of the time that the intake valve is open. This may be accomplished by causing the intake valve to open prior to the end (TDC) of the exhaust upstroke of the piston. In that instance, the intake valve remains open for greater than a 90-degree rotation of the intake valve cam. The intake valve cam follower would then be configured to cause lifting and lowering of the cam follower 40 over a rotational period of greater than 90 degrees, for example, 100 degrees. The intake valve cam and exhaust valve cam would then be positioned on the cam shaft to allow the additional 10 degrees of intake valve opening to occur prior to completed lowering of the cam follower for the exhaust valve. This would equate to a valve overlap of 10 cam-degrees, or 20 crankshaft-degrees.

Modification of the camshaft alone controls only the point of valve opening, and modification of the cam follower alone controls only the duration of valve opening and closing. The preferred embodiment of the invention utilizes both in combination as explained above.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. In a reciprocating piston engine which utilizes a camshaft to open and close exhaust and intake valves through respective cam followers, the improvement which comprises:

a camshaft having at least one pair of an intake valve cam and an exhaust valve cam, each said intake valve cams and each said exhaust valve cams having a cam lobe defining an opening ramp, a nose and a closing ramp shaped to cooperate with and to engage a bottom of a respective cam follower to translate said cam follower through a single reciprocating to and fro motion over an about 90-degree rotation of said cam and wherein one of said intake valve cams and one of said exhaust valve cams are positioned on said camshaft with respect to one another to control when said intake valve cam engages and translates its respective said cam follower in relation to when said exhaust valve cam engages and translates its respective cam follower;

each said cam follower having an elongated body having a first end and a second end, said first end having means for receiving a valve stem or push rod, said second end having a leading edge which is first engaged by a rotating respective said intake valve cam or a rotating respective said exhaust valve cam, and a trailing edge opposing said leading edge, said trailing edge defining a substantially planar surface which obliquely intersects said elongated body and which has a lower end adjacent said leading edge, said second end also having a shoulder extending a length of an intersection between said leading edge and said trailing edge, and wherein said trailing edge obliquely intersects said elongated member at an angle that prevents a respective said cam from engaging said trailing edge;

an annular member affixed around said elongated body proximate said first end of said elongated body for preventing said elongated body from traversing through an engine block of the reciprocating piston engine below a predetermined level;

a spring washer encircling said elongated body disposed between said annular member and the engine block for upward biasing said cam follower;

a pin member protruding from a wall of a bore in an engine block of the reciprocating piston engine for receiving said elongated body, and wherein said elongated body defines a longitudinal slot in an outer surface of said elongated body corresponding to and for receiving said pin member, whereby when said elongated body reciprocally translates within the bore said pin member engages and traverses said slot but said elongated body is prevented from rotating about a longitudinal axis of said elongated body; and wherein upon rotation of said camshaft said at least one pair of an intake valve cam and an exhaust valve cam respectively engage and cooperate with said corresponding cam followers to lift and lower said corresponding cam followers according to a desired initiation and duration of an exhaust valve opening and closing and an intake valve opening and closing.

2. A cam follower for being engaged by a rotating cam to translate a valve stem or push rod comprising:

an elongated member having a first end and a second end, said first end having means for receiving the valve stem or push rod, said second end having a leading edge which is first engaged by the rotating cam and a trailing edge opposing said leading edge, said trailing edge defining a substantially planar surface which obliquely intersects said elongated member and which has a lower end adjacent said leading edge, said second end also having a shoulder extending a length of an intersection between said leading edge and said trailing edge, and wherein said trailing edge obliquely intersects said elongated member at an angle that prevents the rotating cam from engaging said trailing edge.

3. The invention of claim 2, wherein said elongated member is cylindrical.

4. The invention of claim 2, wherein said shoulder comprises a roller.

5. The invention of claim 2, further comprising means for preventing said elongated member from traversing through an engine block below a predetermined level.

6. The invention of claim 5, wherein said means for preventing said elongated member from traversing through an engine block below a predetermined level comprises an annular member affixed around said elongated member proximate said first end of said elongated member.

7. The invention of claim 2, further comprising means for preventing said elongated member from rotating within an engine block about a longitudinal axis of said elongated member.

8. The invention of claim 2, wherein said elongated member defines a longitudinal slot in an outer surface of said elongated member for receiving a pin member installed within a wall of a bore in an engine block which receives said elongated member, and which cooperates with said pin member to allow reciprocating translation of said elongated member in a line parallel to said longitudinal slot but which prevents said elongated member from rotating in the engine block about a longitudinal axis of said elongated member.

9. In a reciprocating piston engine which utilizes a camshaft to open and close exhaust and intake valves through respective cam followers, the improvement which comprises:

a camshaft having at least one pair of an intake valve cam and an exhaust valve cam, each said intake valve cam and each said exhaust valve cam having a cam lobe defining an opening ramp, a nose and a closing ramp shaped to cooperate with and to engage a bottom of a respective cam follower to translate said cam follower through a single reciprocating to-and-fro motion over an about 90-degree rotation of said cam and wherein one of said intake valve cam and one of said exhaust valve cam are positioned on said camshaft with respect to one another to control when said intake valve cam engages and translates its respective said cam follower in relation to when said exhaust valve cam engages and translates its respective cam follower; and each said cam follower having an elongated body having a first end and a second end, said first end having means for receiving a valve stem or push rod, said second end having a leading edge which is first engaged by a rotating respective said intake valve cam or a rotating respective said exhaust valve cam, and a trailing edge opposing said leading edge, said trailing edge defining a substantially planar surface which obliquely intersects said elongated body and which has a lower end adjacent said leading edge, said second end also having a shoulder extending a length of an intersection between said leading edge and said trailing edge, and wherein said trailing edge obliquely intersects said elongated member at an angle that prevents a respective said cam from engaging said trailing edge;

wherein upon rotation of said camshaft said at least one pair of an intake valve cam and an exhaust valve cam respectively engage and cooperate with said corresponding cam followers to lift and lower said corresponding cam followers according to a desired duration and initiation of an exhaust valve opening and an intake valve opening.

10. The invention of claim 9, wherein said elongated body is cylindrical.

11. The invention of claim 9, wherein said shoulder comprises a roller.

12. The invention of claim 9, further comprising means for preventing said elongated body from traversing through an engine block below a predetermined level.

13. The invention of claim 12, said means for preventing said elongated body from traversing through an engine block below a predetermined level comprising an annular member affixed around said elongated body proximate said first end of said elongated body.

14. The invention of claim 13, further comprising a spring washer encircling said elongated body disposed between said annular member and the engine block.

15. The invention of claim 9, further comprising means for preventing said elongated body from rotating within an engine block about a longitudinal axis of said elongated body.

16. The invention of claim 9, further comprising a pin member protruding from a wall of a bore in an engine block of the reciprocating piston engine for receiving said elongated body, and wherein said elongated body defines a longitudinal slot in an outer surface of said elongated body corresponding to and for receiving said pin member, whereby when said elongated body reciprocally translates within the bore said pin member engages and traverses said slot but said elongated body is prevented from rotating about a longitudinal axis of said elongated body.

* * * * *